US010335811B2

(12) United States Patent
Morizane

(10) Patent No.: US 10,335,811 B2
(45) Date of Patent: Jul. 2, 2019

(54) TWO-PHASE FLOW NOZZLE

(71) Applicant: MORIZANE TRANSPORTATION CO., LTD., Niihama, Ehime (JP)

(72) Inventor: Kimihide Morizane, Ehime (JP)

(73) Assignee: MORIZANE TRANSPORTATION CO., LTD. (JP)

( * ) Notice: Subject to any disclaimer, the term of this patent is extended or adjusted under 35 U.S.C. 154(b) by 131 days.

(21) Appl. No.: 15/336,848

(22) Filed: Oct. 28, 2016

(65) Prior Publication Data

US 2017/0128964 A1 May 11, 2017

(51) Int. Cl.

| | |
|---|---|
| ***B05B 7/04*** | (2006.01) |
| ***B05B 7/10*** | (2006.01) |
| ***B05B 7/02*** | (2006.01) |
| ***B05B 7/08*** | (2006.01) |

(52) U.S. Cl.

CPC ..... *B05B 7/10* (2013.01); *B05B 7/025* (2013.01); *B05B 7/0458* (2013.01); *B05B 7/0483* (2013.01); *B05B 7/0815* (2013.01)

(58) Field of Classification Search

CPC ... B05B 7/0025; B05B 7/0815; B05B 7/0483; B05B 7/066; B05B 7/067; B05B 7/068; B05B 7/10; B05B 7/025; B05B 7/0458; B05B 7/0475; B05B 7/06; B05B 7/0075; B05B 7/00; B01F 2005/002

USPC ..... 239/406, 398, 418, 419, 421, 426, 433, 239/434, 434.5, 423, 424, 424.5

See application file for complete search history.

(56) References Cited

U.S. PATENT DOCUMENTS

2006/0169800 A1* 8/2006 Rosell ..... A61M 11/06 239/418
2007/0001029 A1* 1/2007 Kjeldal ..... B05B 7/0475 239/406
2012/0104119 A1* 5/2012 Benalikhoudja ..... B05B 7/0012 239/398

FOREIGN PATENT DOCUMENTS

JP 5-337405 A 12/1993

* cited by examiner

*Primary Examiner* — Arthur O. Hall
*Assistant Examiner* — Juan C Barrera
(74) *Attorney, Agent, or Firm* — Renner Kenner Greive Bobak Taylor & Weber

(57) ABSTRACT

A two-phase flow nozzle, having limited dimensions of main parts relating to size of atomized particle and having practical means to assure the important dimension is provided. The nozzle is composed with the first liquid passage, the liquid nozzle with a liquid splaying exit, a concave located at an end of the liquid nozzle where said liquid exit is located lower than said end of liquid nozzle, a gas nozzle having a gap to supply compressed gas for atomizing from the outer periphery of said liquid nozzle to the liquid injected from said liquid exit, and a gas nozzle having a gas exit, wherein said gap is formed by sticking the minute extrusion composed integrally on said liquid nozzle with said gas nozzle or sticking the minute extrusion composed integrally on said gas nozzle with said liquid nozzle.

9 Claims, 5 Drawing Sheets

TWO-PHASE FLOW NOZZLE

FIELD OF THE INVENTION

This invention relates to a two-phase flow nozzle, more particularly, an injection nozzle to atomize mixed flow of liquid and gas. In detail, it is suitable for the use of painting equipment, fuel burning equipment, humidifier, steam iron, cooling fan using latent heat of evaporation or lubrication device for machine tools, etc.

DESCRIPTION OF THE RELATED ART

JP, H05-337405, A discloses a related art of two-phase flow nozzle as shown on FIG. 5. In FIG. 5, a liquid nozzle 5 having a liquid chamber 6 in the center is fastened by screw to a nozzle holder 7. A liquid passage 8 is composed in said nozzle holder 7.

The liquid is compressed and supplied from a liquid feeding passage 9, which is fastened to the bottom end of the nozzle holder 7, to the liquid chamber 6 via the liquid passage 8 and a filter 11. A minute liquid exit 10 is composed at a top end of the liquid nozzle 5. A liquid nozzle recess 12 is composed in the liquid nozzle 5 around the center axis of the liquid exit where the liquid exit 10 is located slightly lower than the top end of the liquid nozzle 5. The nozzle holder 7 having the liquid nozzle 5 is installed in a gas nozzle 13 (the installment method is not shown in detail). At a top end of the gas nozzle 13, a gas exit 14 is composed as symmetrical to the center axis of the liquid nozzle 5 where the diameter of the gas exit 14 is slightly larger than that of the nozzle recess 12. At a side of the gas nozzle, a gas feeding tube 15 is connected and a compressed air for atomization is supplied from a gas passage 16 to the gas exit 14 via a gap 17. Accordingly, the liquid, which is injected from the liquid exit 10, is sheared by gas flow and atomized. Further, in this embodiment, it is shown that, in the case that the liquid nozzle recess is composed, the atomization of the liquid is more promoted than the case that the liquid nozzle recess is not composed, because a swirl is produced in the atomized gas and this swirl helps the liquid injected from the liquid exit to produce a turbulent flow in the liquid and a shearing by a high speed gas is acted.

LIST OF PRIOR ART DOCUMENTS

Patent Documents

Patent document 1: JP, H05-337405, A

SUMMARY OF THE INVENTION

Problems to be Solved by the Invention

The known arts described above, although the size of the injected particles is effected complicatedly by the pressure and flow volume of liquid and gas, shape of the liquid nozzle recess 12 and the gap 17 between the liquid nozzle 5 and the gas nozzle 13, the relationship of these factors are not shown clearly. Accordingly, it is not enough to have a practical effect to obtain the desired size of particles for a wide range of flow volume only by the information disclosed in the open laid publication.

Further, although it has been found that said gap 17 is the most effective factor to the size of the injected particles, it is very difficult to keep the gap 17 to the desired value, because the real dimension of said gap 17 is effected by four manufacturing dimensional tolerances that are of the relative assembling location of the gas nozzle 13 and the nozzle holder 7, height of the nozzle holder 7, inside height of the gas nozzle 13 and the height of the liquid nozzle 5.

Moreover, it is a problem to be solved that disassembling and reassembling of the liquid nozzle 5, which has a minute diameter for liquid flow, for cleaning is difficult.

Accordingly, it is an object of the present invention to provide a two-phase flow nozzle with limited main dimensions which relate to the size of injected particles and with a practical way to make sure to keep the dimension of the gap 17 to be the desired value. Further, it is another object of this invention to provide a two-phase flow nozzle having practical sealing means to protect leakage of liquid keeping the dimension of the gap to be a desired value and assembling and disassembling means for cleaning of the liquid nozzle 5.

Solution to the Problems

The problems above are solved by the two phase flow nozzle as the following (1)~(7).

(1) A two phase flow nozzle comprising a liquid nozzle having a first liquid passage and a liquid spraying exit injecting liquid from the first liquid passage, a recess which is provided at a top end of said liquid nozzle so that the liquid spraying exit is lower than the top end of said liquid nozzle, and a gas nozzle having a gas spraying gap feeding compressed gas for atomizing from circumference of the liquid nozzle and a gas spraying aperture; wherein said gas spraying gap is formed by closely contacting a minute extrusion, which is composed integrally on a upper surface at atop end of said liquid nozzle, to said gas nozzle, or said gas spraying gap of the gas exit is formed by closely contacting a minute extrusion, which is composed integrally on an opposed surface facing the top end surface of said liquid nozzle, to said liquid nozzle.

(2) The two-phase flow nozzle in (1) above, further comprising; a nozzle holder provided with a containable space for the liquid nozzle to contain a lower portion of said liquid nozzle, the nozzle holder having a bottom part and an upper part extending upwardly from said bottom part with a smaller diameter, an outer case provided with a containable space for an assembled body of said liquid nozzle and said nozzle holder to contain the assembled body, a gas passage composed between an inner wall of said containable space of said assembled body and the outer periphery of said assembled body and communicated with said gas spraying gap, a gas feeding tube communicated with said gas passage, a second liquid passage composed in said nozzle holder and communicated with said first liquid passage, and a liquid feeding passage having a third liquid passage which communicates with said second liquid passage; wherein said gas nozzle is fastened to said outer case making a space between the outer case, and the compressed gas is sealed to prevent from leakage to the outside by filling an elastic material in said space.

(3) The two-phase flow nozzle in (2) above, wherein said liquid nozzle is loosely fitted to said containable space of liquid nozzle and said nozzle holder is loosely fitted to said containable space of assembled body.

(4) The two-phase flow nozzle in one of (1)~(3) above, wherein said gas spraying hole is shaped to be a cylinder or a truncated cone of which the exit diameter is larger than the inlet diameter, said first liquid passage is shaped to be a cylinder, wherein said gas spraying hole is provided with eccentricity of the center axis of the gas spraying hole to the center axis of said first liquid passage is equal to or less than 10% of the diameter of said first liquid passage, and wherein said gas feeding tube is inclined to the center axis of said liquid nozzle toward the direction of liquid injection.

(5) The two-phase flow nozzle in claim 1), wherein $\phi C/\phi A=1.25\sim1.55$, where $\phi A$ is the diameter of said liquid exit of said liquid nozzle and, $\phi C$ is diameter of inlet of said gas exit.

(6) The two-phase flow nozzle in (1) above, wherein $\phi B/\phi C=1.25\sim2$ and or $D/\phi A=0.2\sim1.0$, where $\phi A$ is the diameter of said liquid exit of said liquid nozzle, $\phi B$ is the diameter of the recess which is located at an end of said liquid nozzle to be lower than said liquid nozzle, $\phi C$ is the diameter at the inlet of said gas exit and D is the depth of said recess.

(7) The two-phase flow nozzle in (1) above, $\delta/\phi A=0.08\sim0.15$, wherein $\phi A$ is the diameter of said liquid exit of said liquid nozzle and $\delta$ is the height of the minute extrusion which is composed integrally on the upper surface of said liquid nozzle or composed integrally on the surface of said gas nozzle.

Summary of the Solution

As summary, the means to achieve the objects above are to compose a minute extrusion, which is composed integrally on part of a upper surface at a top end of liquid nozzle 5 and has a height equal to a minute gap 17, wherein said gas nozzle 13 and nozzle holder 7 are fastened by screws and a minute gap between liquid nozzle 5 and gas nozzle 13 is secured to be the desired value.

Advantageous Effects of the Invention

It is believed that the two-phase flow nozzle in accordance with present invention will have the following advantage. Further, a sign with parenthesis in the item of ADVANTAGEOUS EFFECT OF THE INVENTION is a sign which is put to a part or a material, etc. in the item of DESCRIPTION OF THE EMBODIMENT, The two-phase flow nozzle in accordance with the present invention is composed with a first liquid passage, a liquid nozzle to inject liquid from said first liquid passage, a recess formed at an top end of said liquid nozzle with a liquid splaying exit located lower than the top end of the liquid nozzle, and a gas nozzle located at the periphery of the liquid nozzle to supply compressed gas for atomizing to the liquid injected from the liquid exit. A turbulent flow in the compressed gas for atomizing is produced around the liquid exit and this turbulent flow crosses the main liquid flow injected from the liquid exit and produces turbulent in the liquid. Further, shearing force by high speed gas is added to the injected liquid. Accordingly, a mist of fine particles with a wide range of injection volume can be obtained using gas with low pressure and low rate of discharge.

Another advantage of the present invention is that the gap $\delta$ between the gas nozzle and the liquid nozzle which mostly influences to the size of the injected particles is easily kept to the desired value by the way that the dimension of the gap depends only on the manufacturing tolerances of a single part 5 or 13. Further, the two phase flow nozzle can be easy to design by relating the dimensions of composed parts each other. Moreover, sealing of two-phase flow can be obtained easily by a practical composition.

Because the gas feeding tube is composed to direct to the liquid exit with inclination to the center axis of the liquid exit as illustrated in FIGS. 1 and 4, flow of the gas is smoother than FIG. 5 of the known art.

In the known art previously described, as for cleaning of dust in the liquid or the gas or clogs by impurities in the holes or gaps of the nozzle, it is difficult to disassemble the air nozzle from the nozzle holder or disassemble liquid nozzle from the nozzle holder. However, in the present invention, the gas nozzle is easily disassembled only by loosening the fastening screw with the outer case. Also, as the liquid nozzle is installed in the nozzle holder with an appropriate clearance, it is easy to disassemble and clean.

DESCRIPTION OF THE EMBODIMENT

Figure 1:
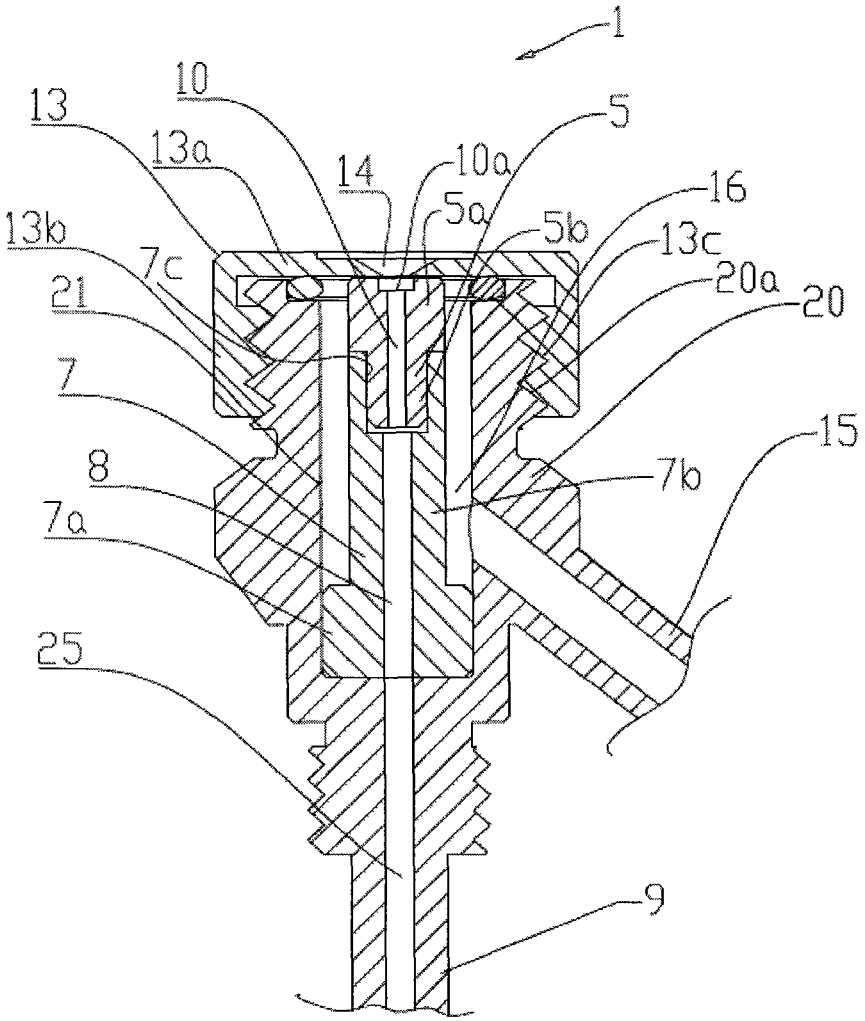
FIG. 1 is a cross sectional side elevation view of the two-phase flow nozzle.
Figure 2:
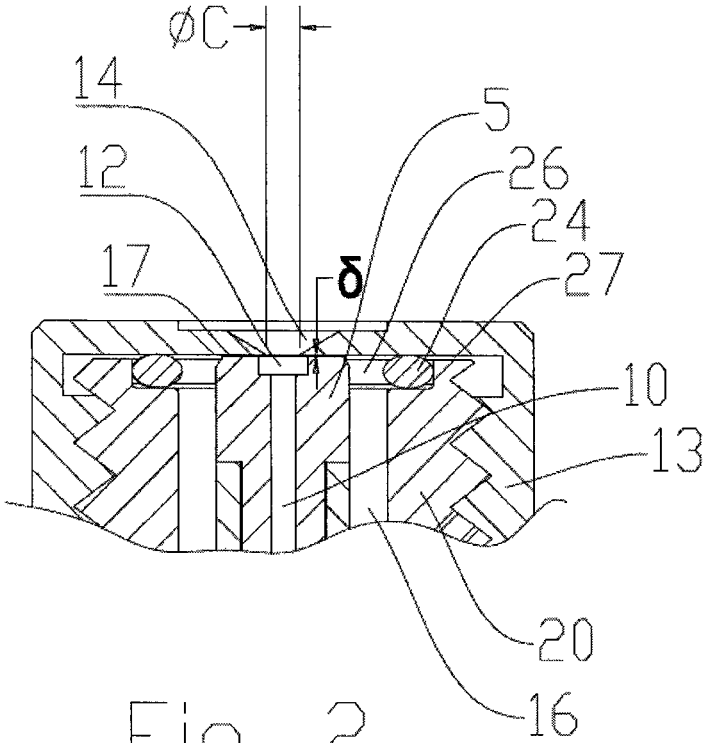
FIG. 2 is a cross sectional side elevation view of the two-phase flow nozzle shown in FIG. 1 showing the main parts enlarged.
Figure 3:
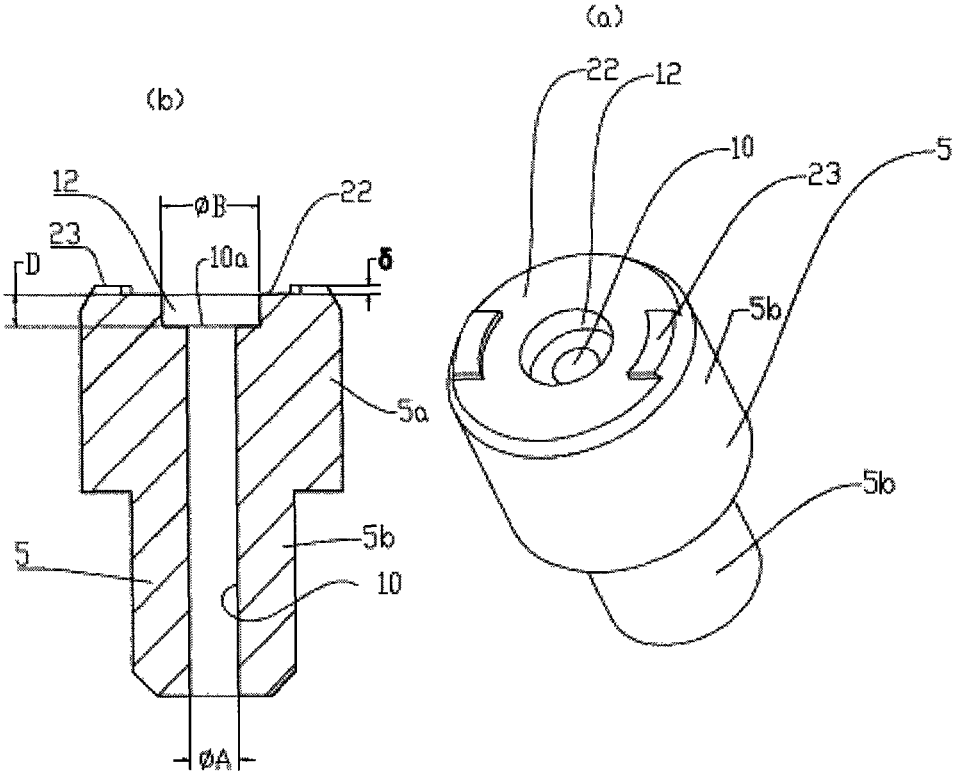
FIG. 3(*a*) is an oblique drawing of the two-phase flow nozzle shown in FIG. 1 and FIG. 3(*b*) is a cross sectional side elevation view of it.

FIG. 1 is a cross sectional side elevation view of the two-phase flow nozzle of the present invention. FIG. 2 is a partial enlarged view of FIG. 1. A two-phase flow nozzle 1 is composed with a liquid nozzle 5, a nozzle holder 7, a gas nozzle 13 and outer case 20. FIG. 3 is an enlarged view of said liquid nozzle 5. As shown in FIG. 3, said liquid nozzle 5 is composed with an upper large diameter part 5*a*, a lower small diameter part 5*b* and a first liquid passage 10 formed by penetrating the liquid nozzle vertically.

Said nozzle holder 7 is composed with a bottom part 7*a*, small diameter part 7*b* which is elongated from said bottom part 7*a*, a containable space for the liquid nozzle 7*c* having a cylindrical hole which is located at said small diameter part 7*b*, a second liquid passage 8 which is communicated from the bottom of said bottom part 7*a* to the bottom of said containable space 7*c* of the liquid nozzle. It is desirable that a diametrical size of said upper larger part 5*a* is the same as that of said lower small diameter part 7*b*. Said small diameter part 5*b* of said liquid nozzle 5 is installed with a slight clearance into the containable space for the liquid nozzle 7*c*. At an upper end of said first liquid passage 10, a liquid splaying exit 10*a* is composed. As illustrated in FIGS. 2 and 3, an upper surface 22 of the liquid nozzle 5 is a plane which is perpendicular to said first liquid passage 10. On some parts of said upper surface 22, extrusions 23, having a minute height with an object described later, are composed.

Said gas nozzle 13 is composed with a circular upper plate 13*a* and a cylindrical body 13*b* elongated from the periphery of said upper plate 13*a* to the lower direction. At the center of said upper plate 13*a*, a gas exit 14 is formed. At the inner wall of said cylindrical body 13*b*, a female screw 13*c* is formed. The eccentricity of the center axis of said gas exit 14 with the center axis of said first liquid passage 10 is desirable to be equal or less than 10% of the diameter of said first liquid passage 10. Especially, it is more preferable that both axes are coaxial.

A storage space of assembled body 21 having a cylindrical hole is composed in said outer case 20 to contain an assembled body of said nozzle holder 7 and said liquid nozzle 5. The bottom part 7*a,* having larger diameter, of said nozzle holder 7 is installed into said storage space of assembled body 21 with a slight clearance. Further, on the upper outer periphery wall of said outer case 20, a male screw 20*a* to mate the female screw 13*c* on said gas nozzle 13 is formed.

When said gas nozzle 13 is fastened to the upper portion of the outer case 20 by the female screw 13*a* and the male screw 20*a,* the lower surface of the circular upper plate 13*a* is stuck on a extrusion 23 which is composed on a part of the upper surface 22 of said liquid nozzle 5 having a minute height 6, wherein a gap of the gas exit 17 is formed, in a space without said extrusion 23, between the upper surface 22 of said liquid nozzle 5 and the lower surface of gas nozzle 13.

A gas passage 16 to communicate with said gap of the gas exit 17 is formed between the inner wall of said storage space of assembled body 21 of said outer case 20 and the outer wall of the upper large diameter part 5*a* and between the inner wall of said storage space of assembled body 21 of said outer case 20 and the outer wall of the small diameter part 7*b* of said nozzle holder 7.

On the outer periphery of said outer case 20, a gas feeding tube 15 is composed to direct gas to said liquid exit 10*a* with inclination to the center axis of said liquid exit 10*a* and communicates to said gas passage 16.

On the lower portion of said outer case 20, a liquid feeding passage 9 is composed integrally with said outer case 20. On the center of said liquid feeding passage 9, a third liquid passage 25 is formed and communicates to said second liquid passage 8.

As best illustrated in FIG. 2, a circular liquid nozzle recess 12 is composed at a top end of said liquid nozzle 5 coaxially with said liquid exit 10*a* where said liquid exit 10*a* is located to be slightly lower than the top end of the liquid nozzle 5.

The compressed gas injected through said gap of the gas exit 17 shears the compressed liquid injected from the liquid exit 10*a* and atomizes the liquid. As described by said known art in detail, the pressure of the gas in the liquid nozzle recess 12 becomes negative, so that a part of the gas to atomize, which injects from the gas exit 14 of the gas nozzle 13, produces a turbulent flow around the liquid exit 10*a.* As this turbulent flow crosses the main liquid flow injected from the liquid exit 10*a* and produces turbulent in the liquid, a mist of fine particles can be obtained using gas with low pressure and low rate of discharge.

For instance, in case of that the liquid is water and the gas is air, the diameter of first liquid passage 10 (liquid exit 10*a*): $\phi A$=0.6 mm, the water pressure is 100 kPa, gas pressure is 90 kPa, the diameter of the liquid nozzle recess 12: $\phi B$=1.2 mm, the depth of the liquid nozzle recess 12: D=0.6 mm, the diameter of the gas nozzle 13: $\phi C$=0.9 mm, $\delta$=0.06 mm, rate of discharge of air is 4.9 l/min, rate of water flow is 7.5 ml/min, fine atomized particles sized 10~30μ are obtained.

According to various experiments, the size of atomized particle depends on compressing pressure of liquid and gas, and geometrical figures of passages of liquid and gas, so that the dimensions of main parts composing the nozzle should have relationship each other in order to obtain a desired particle size.

It is found that by experiments, it is desirable that $\varphi C/\varphi A$ is 1.25~1.55, $\phi B/\phi C$ is 1.25~2 and $D/\phi A$ is 0.2~1.0.

The most important dimension is the height $\delta$ of the fine extrusion 23 to form said gap of the gas exit 17. It is desirable that $\delta/\phi A$ is 0.08~0.15 but it may be determined in accordance with the object of application. In the best illustrated case, $\delta$ is 0.06 mm.

To assure the dimension of $\delta$ is difficult but is absolutely necessary. In the present invention, it is easy to assure $\delta$ by specifying shape and arrangement of parts to compose the nozzle without complicated manufacturing method. That is, as described before, because the gas nozzle 13 is fastened by a screw to the outer case 20 so as the lower surface of the circular upper plate 13*a* is stuck to the extrusion 23 of the liquid nozzle 5, the height of the gap of the gas exit 17, which is the minimum clearance, depends only on accuracy of the height 6 of the extrusion 23. Because the extrusion 23 formed on the liquid nozzle 5 is made by molding process of plastics or machinery process of metals integrated with the liquid nozzle 5, accuracy of the height $\delta$ can be easily secured. It is desirable that said extrusion 23 is composed on the liquid nozzle 5 but it is also preferable to compose the extrusion 23 on the lower surface of the circular upper plate 13*a*.

Further, when the gas nozzle 13 is fastened so as the inner surface of the gas nozzle is stuck to the extrusion 23, a slight clearance 27 is made between the upper surface of the outer case 20 and the lower surface of the circular upper plate 13*a* of the gas nozzle 13. Said slight clearance prevents said lower surface of the circular upper plate 13*a* from interference with the outer case 20 to keep the important minute clearance $\delta$.

Additionally, a circular recess 26 is composed on the upper surface of the outer case 20 around the storage space of assembled body 21, wherein an elastic material 24 such as O-ring is installed in said cavity 26 and has contact with said lower surface of the gas nozzle 13 so that compressed gas in the gas passage 16 is sealed.

Figure 4:
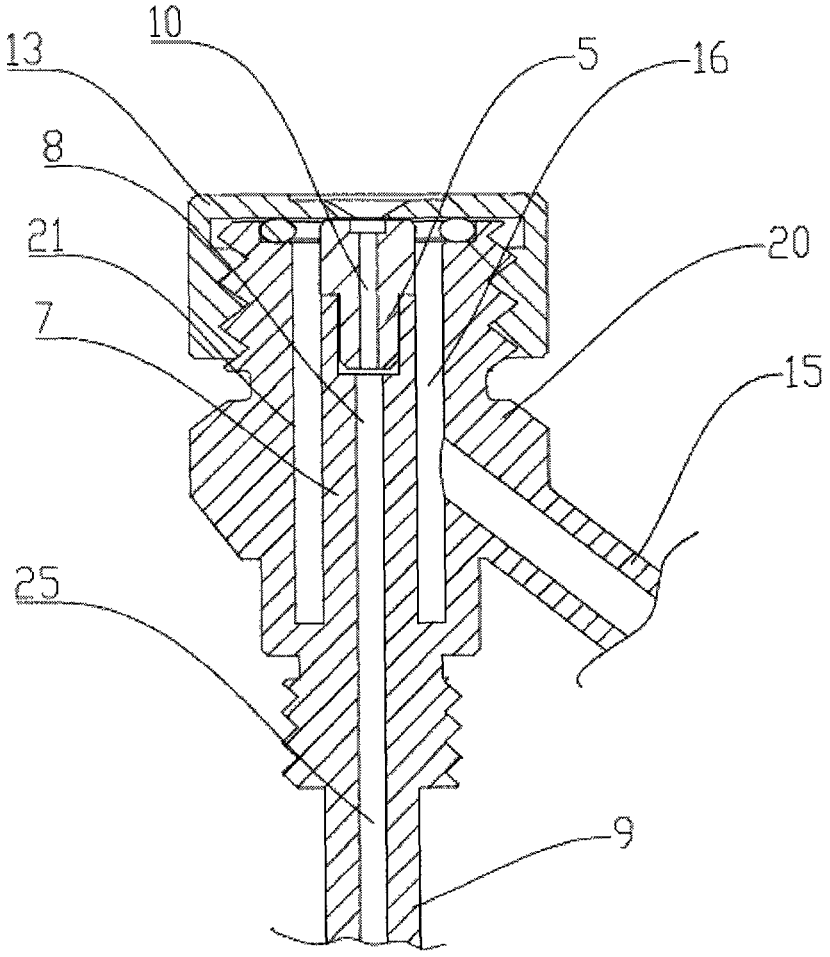
FIG. 4 is a cross sectional side elevation view of another embodiment of two-phase fluid nozzle in this invention.
Figure 5:
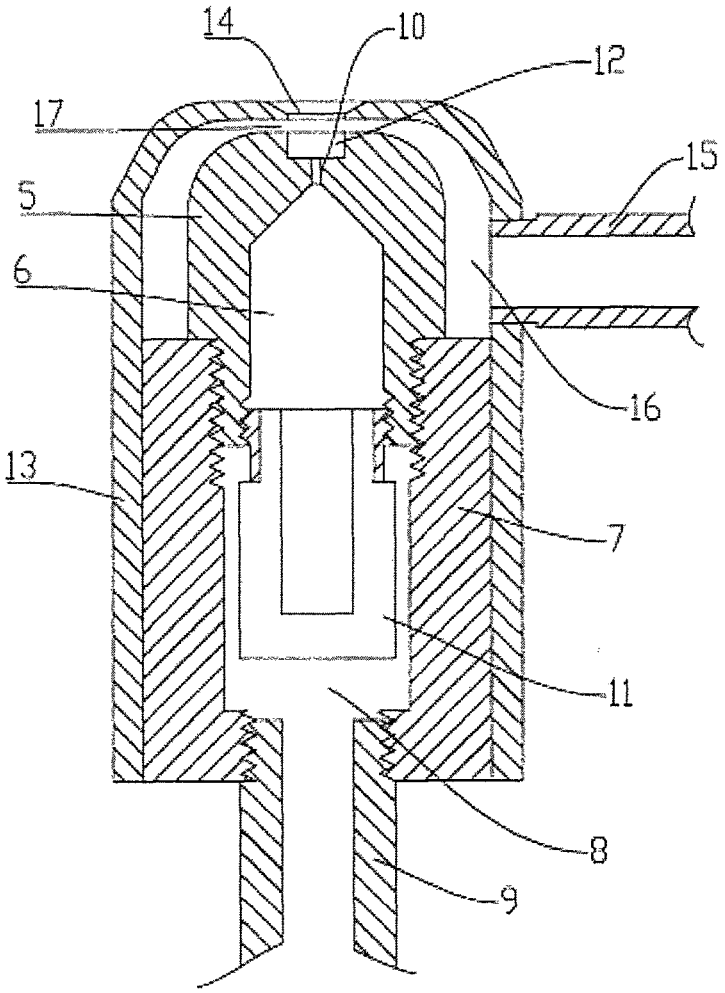
PRIOR ART Fig. 5
FIG. 5 is a cross sectional side elevation view of a conventional two-phase flow nozzle.

FIG. 4 shows another embodiment of two-phase flow nozzle by this invention, wherein composition of two-phase flow nozzle is the same as shown in FIGS. 1-3 except that the nozzle holder 7 is composed integrally with the outer case 20 by plastic molding process, etc.

What is claimed is:

1. A two-phase fluid spraying nozzle comprising; a liquid nozzle having a first liquid passage and a liquid spraying exit having a diameter of $\varphi A$ and injecting liquid from the first liquid passage, a circular recess having a diameter of $\varphi B$ and which is provided at a top end of said liquid nozzle so that the liquid spraying exit comes to be lower than a top surface of said liquid nozzle, and a gas nozzle having a plurality of gas exiting gaps at a gas exit feeding compressed gas for atomizing the compressed gas from the gas exit; wherein $\varphi A$ is smaller than $\varphi B$; wherein a plurality of extrusions, which are composed integrally on an upper surface at an end of said liquid nozzle and each of the plurality of extrusions having a pair of sidewalls, contact the lower surface of said gas nozzle, and are circumferentially spaced from each other so that said gas exiting gaps of the gas exit are formed by the upper surface of the liquid nozzle, the lower surface of the gas nozzle, and respective sidewalls of the plurality of extrusions; wherein the compressed gas exiting from said gas exiting gaps flows into the circular recess and becomes turbulent flow which thereby impinges on a liquid flow from the liquid spraying exit so as to make a mist therefrom; wherein the top surface of the liquid nozzle and the plurality of extrusions are perpendicular with the first liquid passage.

2. The two-phase nozzle as set forth in claim 1, further comprising; a nozzle holder provided with a containable space having a cylindrical inner hole to contain the liquid nozzle at a lower portion of the liquid nozzle having a cylindrical outer periphery, the nozzle holder having a bottom part having a cylindrical outer periphery, and an upper part extending upwardly from said bottom part with a cylindrical outer periphery with smaller outer diameter than the outer diameter of the bottom part, an outer case provided with a cylindrical inner hole for an assembled body of said liquid nozzle and said nozzle holder to install the assembled body, a gas passage composed between the cylindrical inner hole of said outer case and the cylindrical outer periphery of said upper part of said nozzle holder and communicated with said gas exiting gaps, a gas feeding tube communicated with said gas passage, a second liquid passage composed in said nozzle holder and communicated with said first liquid passage, and a liquid feeding passage having a third liquid passage which communicates with said second liquid passage; wherein said gas nozzle is fastened to said outer case making a space between the outer case, and the compressed gas is sealed to prevent from leakage to the outside by filling an elastic material in said space.

3. The two-phase nozzle as set forth in claim 2, wherein the cylindrical outer periphery of said lower portion of said liquid nozzle is slideably fitted to the inner hole of said containable space of said nozzle holder and the cylindrical outer periphery of said bottom part of said nozzle holder is slideably fitted to the inner hole of the outer case.

4. The two-phase nozzle as set forth in claim 3, wherein said gas exit is shaped to be a cylinder or a truncated cone having an exit diameter larger than an inlet diameter, said first liquid passage is shaped to be a cylinder, wherein said gas exit is provided with eccentricity of the center axis of the gas exit to the center axis of said first liquid passage to be equal to or less than 10% of the diameter of said first liquid passage, and wherein said gas feeding tube is inclined to the center axis of said liquid nozzle toward the direction of liquid injection.

5. The two-phase nozzle as set forth in claim 2, wherein said gas exit is shaped to be a cylinder or a truncated cone having an exit diameter larger than an inlet diameter, said first liquid passage is shaped to be a cylinder, wherein said gas exit is provided with eccentricity of the center axis of the gas exit to the center axis of said first liquid passage to be equal to or less than 10% of the diameter of said first liquid passage, and wherein said gas feeding tube is inclined to the center axis of said liquid nozzle toward the direction of liquid injection.

6. The two-phase nozzle as set forth in claim 2, wherein said elastic material is an O-ring, which is installed between the lower surface of the gas nozzle and the surface of the outer case opposite to it.

7. The two-phase nozzle as set forth in claim 1, wherein said gas exit is shaped to be a cylinder or a truncated cone having an exit diameter larger than an inlet diameter, said first liquid passage is shaped to be a cylinder, wherein said gas exit is provided with eccentricity of the center axis of the gas exit to the center axis of said first liquid passage to be equal to or less than 10% of the diameter of said first liquid passage, and wherein said gas feeding tube is inclined to the center axis of said liquid nozzle toward the direction of liquid injection.

8. The two-phase nozzle as set forth in claim 1, where $\varphi C$ is diameter of inlet of said gas exit, where D is the depth of said recess, and where $\delta$ is the height of the plurality of extrusions which is composed integrally on the upper surface of said liquid nozzle or composed integrally on the surface of said gas nozzle, wherein $\varphi C/\varphi A=1.25\sim1.55$, wherein $\varphi B/\varphi C=1.25\sim2$ and/or $D/\varphi A=0.2\sim1.0$, and wherein $\delta/\varphi A=0.08\sim0.15$.

9. The two-phase nozzle as set forth in claim 1, wherein said liquid nozzle is made of plastics or sintered alloy or metals and said plurality of extrusions are made with molding process of plastics or sintering process of powder metals or machining process of metals.

* * * * *